US005714845A

United States Patent [19]

Heering et al.

[11] Patent Number: 5,714,845

[45] Date of Patent: Feb. 3, 1998

[54] METHOD AND CIRCUIT ARRANGEMENT FOR OPERATING A HIGH PRESSURE GAS DISCHARGE LAMP

[75] Inventors: Wolfgang Heering, Stutensee; Peter Schwarz, Karlsruhe, both of Germany

[73] Assignee: Eta Plus Electronic GmbH u. Co. KG, Nutringen, Germany

[21] Appl. No.: 640,631

[22] Filed: May 1, 1996

[30] Foreign Application Priority Data

May 4, 1995 [DE] Germany ..... 195 16 052 5

[51] Int. Cl.[6] ..... H05B 37/02

[52] U.S. Cl. ..... 315/174; 315/176; 315/DIG. 4; 315/160

[58] Field of Search ..... 315/307, DIG. 4, 315/176, 174, 86, 160

[56] References Cited

U.S. PATENT DOCUMENTS

| | | | |
|---|---|---|---|
| 4,362,971 | 12/1982 | Sloan, Jr. | 315/176 |
| 4,587,460 | 5/1986 | Murayama et al. | 315/174 |
| 4,612,478 | 9/1986 | Payne | 315/176 |
| 4,682,083 | 7/1987 | Alley | 315/307 |
| 5,099,176 | 3/1992 | Fellows et al. | 315/86 |
| 5,270,618 | 12/1993 | Nilssen | 315/176 |

FOREIGN PATENT DOCUMENTS

| | | |
|---|---|---|
| 1589131 | 4/1970 | Germany . |
| 2015769 | 10/1970 | Germany . |
| 3149993 | 6/1983 | Germany . |
| 3715162 | 11/1988 | Germany . |
| 4301184 | 7/1994 | Germany . |
| 1422486 | 1/1976 | United Kingdom . |

*Primary Examiner*—Robert Pascal
*Assistant Examiner*—Arnold Kinkead
*Attorney, Agent, or Firm*—Roylance,Abrams,Berdo & Goodman, L.L.P.

[57] ABSTRACT

A high pressure gas discharge lamp is operated with normal output by at least predominantly low frequency energy supplied from a conventional power supply unit, and is operated at lower than 25 percent of the normal output by at least predominantly high frequency energy supplied from an electronic power supply unit. The electric output fed to the lamp is controlled. At any level of operation, a steady burning of the lamp for saving service life of the lamp is guaranteed. The switching arrangement, in addition to a conventional power supply unit, has an electronic power supply unit. The electronic power supply unit feeds the lamp with energy at a frequency which is higher than that of the energy supplied from the conventional power supply unit.

18 Claims, 1 Drawing Sheet

METHOD AND CIRCUIT ARRANGEMENT FOR OPERATING A HIGH PRESSURE GAS DISCHARGE LAMP

FIELD OF THE INVENTION

The present invention relates to a method for operating of a high pressure gas discharge lamp at different levels of operation. A first level corresponds to operation with normal output. A second level corresponds to operation with a lower output compared to the normal output. The present invention also relates to a circuit arrangement for performing this method.

BACKGROUND OF THE INVENTION

In the known method of this type, the high pressure gas discharge lamp is operated with a line or mains frequency at all levels of operation, because of the conventional power supply units. The conventional power supply units generally include an impedance coil, a transducer or a stray field transformer, and have the same frequency at their output as at their input, which is connected to the network. With operation of the high pressure gas discharge lamp connected to such conventional power supply unit, it is impossible to reduce the lamp output to lower than approximately 40 percent of the normal output, without shortening the life of the lamp. However, temporary operation of the lamp at a lower output in a lamp saving manner is useful.

SUMMARY OF THE INVENTION

An object of the present invention is to provide a method of operating a high pressure gas discharge lamp, without reducing the life of the lamp, even with an output below 40 percent of normal output.

The foregoing object is basically obtained by a method of operating a high pressure gas discharge lamp at different output levels. The method comprises the steps of selectively operating the lamp at a first output level powered at least predominantly with a low frequency energy supplied from a conventional power supply unit, and selectively operating the lamp at a second output level powered at least predominantly with a high frequency energy supplied from an electronic power supply unit. Electronic output from the electronic power supply unit is regulated and maintained such that the second level is at a value less than 25 percent of the first output level but adequate for steady lamp burning to prevent a diminishing of the service life of the lamp.

The lamp is operated exclusively or predominantly with network frequency energy only for normal output. For reduced output, when it is operated with output below 25 percent of normal output, the lamp is operated exclusively or predominantly with high frequency energy. Thus, a steady, lamp saving operation can be realized. An operation, for instance for the purpose of drying a substrate, using lower than 25 percent of normal output is advantageous when a substrate is being dried by radiation by the lamp and the drying process must be interrupted temporarily. However, to conserve energy, it can also be desirable to provide a standby operation in which the high pressure gas discharge lamp is operated with a lower output.

preferably, at the second level of operation, the lamp output is held to between 10 percent and 15 percent of normal output. The use of energy and the radiation output are then correspondingly reduced. However, the lamp can be brought back to its normal output in a very short time.

In one preferred embodiment, at least a third level of operation is provided. In the third operation level, the lamp output is held to a minimum, comprising a very low percentage of the normal output, for example, 1–5 percent. At this third level of operation, it is advantageous to regulate the lamp current to assure that a lamp saving arc discharge with hot focal spots is guaranteed to occur continuously on the electrodes. This contributes to a lamp saving during operation and to the disappearance of reignition sparks, which are completely avoided.

Since the length of time required to bring a lamp from a reduced level of operation to a normal output level of operation is progressively greater with the greater the output differential, it is practical to provide a top standby operational position or mode with an output between 10 percent and 25 percent and a bottom standby operational position or mode with an output of an even lower percentage of the normal output. As a result of cutting-in of the low frequency energy supplied from the conventional power supply unit, the lamp can be brought back to its normal output with complete radiation emission in a time period of fewer than 10 seconds.

Another object of the present invention is to provide a switching arrangement for performing the method according to the present invention.

The foregoing object is basically obtained by a circuit arrangement for operating a gas discharge lamp at different output levels, comprising a high pressure gas discharge lamp. A convention power supply unit is connected to the lamp for supplying electrical energy to the lamp at a first frequency. An electronic power supply unit is connected to the lamp for supplying electrical energy to the lamp at a second frequency. The second frequency is higher than the first frequency.

The lamp could be operated at all levels of operation while connected continuously to an electronic power supply unit with high frequency in comparison to the network frequency. In this case electronic power supply unit would have to be designed for the normal output of the lamp. Since a combined main power supply unit is used, comprising a conventional power supply unit and an electronic power supply unit, the electronic power supply unit need be designed for only a considerably lower output than the normal output of the lamp. Overall, this leads to a considerable reduction in cost.

Without further difficulty, the two power supply units can operate simultaneously, if care is taken that disturbing influences on each are precluded on the opposite unit. This can be obtained in a simple manner where the two power supply units are separated from each other by at least one filter on the output side of each. Separating impedance coils, separating capacitors, low pass filters or resonant vibration or frequency circuits, for example, can be used to provide such separation.

For operation of the lamp connected only to the conventional power supply unit or only to the electronic power supply unit, a shifting or switching mechanism can be provided. Such mechanism allows switching from one to the other power supply unit, without the arc discharge being extinguished during the switching process.

In one preferred embodiment, the electronic power supply unit has an arrangement for control of the variable frequency and/or for regulation of the current fed to the lamp or of the output. By this arrangement, the lamp can operate service life saving at all levels in an optimum manner. This arrangement is connected to a transmitter to transmit the actual value of the current supplied to the lamp from the electronic power supply unit and a transmitter to transmit its output voltage.

A variable output frequency of the electronic power supply unit can be attained in a simple manner by means of a rectifier or converter.

Other objects, advantages and salient features of the present invention will become apparent from the following detailed description, which, taken in conjunction with the annexed drawing, discloses a preferred embodiment of the present invention.

BRIEF DESCRIPTION OF THE DRAWING

Referring to the drawing which form a part of this disclosure.

DETAILED DESCRIPTION OF THE INVENTION

Figure 1:
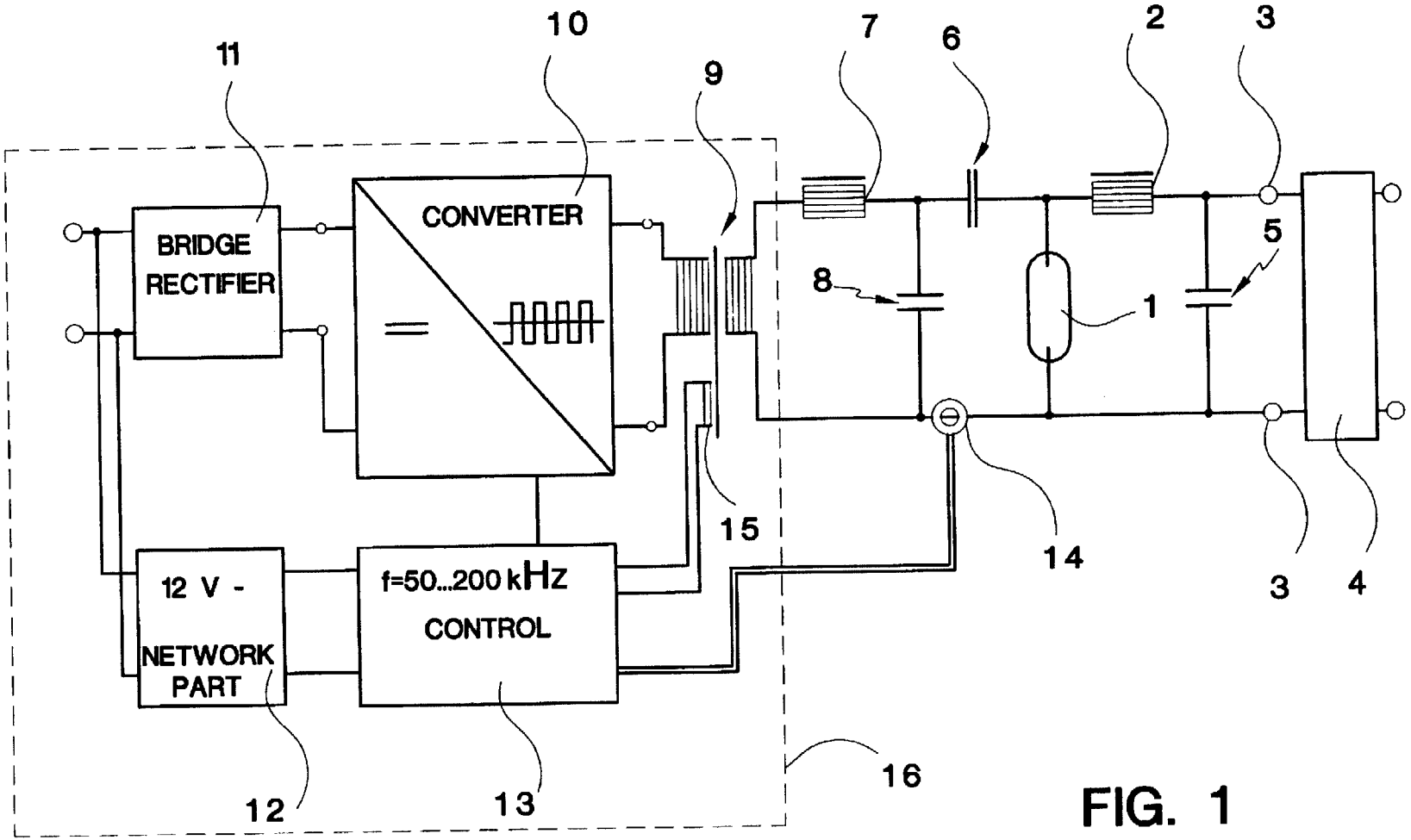
FIG. 1 is a schematic diagram of an apparatus according to the present invention.

A high pressure discharge lamp 1, for example, can serve as radiation source for a drying installation for printed sheets. The lamp is connected on one side through a separating impedance coil 2 to one output of a conventional power supply unit 4 and is connected on the lamp other side directly with another output 3 of conventional power supply unit 4. The conventional power supply unit, for example, includes an impedance coil, a transducer or a stray field transformer.

On the input side, the conventional power supply unit 4 is connected, when in operation, with the 50 - or 60 -Hz low voltage network or grid. A capacitor 5, serving as filter, is also connected to outputs 3. The capacitor forms a short circuit for the higher frequency currents which are not completely suppressed by the separating impedance coil 2.

Lamp 2 is also connected through the intermediary of separating capacitor 6 and a resonant vibration or frequency circuit to the secondary side of a transformer 9. The resonant vibration circuit comprises a vibration circuit impedance coil 7 and a vibration circuit capacitor 8. As shown in the drawing, starting from transformer 9, vibration circuit impedance coil 7 and separator capacitor 6 lie in the one current path leading to lamp 1. The vibration circuit capacitor 8 is connected on one side to this current path between the vibration circuit impedance coil 7 and the separator capacitor 6, and is connected on its other side to the other current path.

The primary side of transformer 9 is connected to the output of a direct current-alternating current converter 10. The converter has a variable output frequency and a variable output voltage. At the input side, direct current-alternating current converter 10 is connected to a bridge rectifier 11. In operation the bridge rectifier is connected with the 50 Hz-low voltage network. A 12V network part can also be connected with this network for supplying the energy for the operation of a control apparatus 13. By means of the control apparatus, the output frequency of the direct current-alternating current converter 10 can be adjusted in a range between 50 and 200 kHz, and its output voltage and output current are also adjustable. This control apparatus 13 is connected to a transmitter 14 to transmit the actual value of the current of lamp 1, and is connected to a voltage transmitter 15 to transmit the output voltage from transformer 9.

Bridge rectifier 11, DC-AC converter 10 with its control apparatus 13 and its network part 12, and transformer 9 form an electronic power supply installation or unit 16. The operation frequency of unit 16 in the exemplary embodiment is 100 kHz. With this arrangement, the resonance frequency of the vibration circuit comprising vibrating circuit impedance coil 7 and vibrating circuit capacitor 8 is 80 kHz. By virtue of this vibration circuit, separating capacitor 6, separating impedance coil 2 and capacitor 5, the conventional power supply unit 4 and the electronic power supply apparatus 16 do not disturb each other. Thus, the two power supply units can be operated simultaneously.

When lamp 1 is being operated with its normal output, the electronic power supply unit is controlled so that essentially all of the energy is supplied from conventional power supply unit 4. However, for example, on account of a short interruption in the transport of the substrate to be dried, the output of lamp 1 may need to be reduced to a level which will not damage the substrate even when the substrate is exposed to radiation from lamp 1 for a long time. In that situation, a top standby operational mode is encountered, with the output of lamp 1 being reduced to approximately 10 percent of normal output. At this level of operation, lamp 1 obtains its energy essentially from electronic power supply unit 16, in other words, in the exemplary embodiment, from an energy source with a frequency of 100 kHz. By virtue of this high frequency and the output control, lamp 1 is operated lamp saving. The lamp burns steadily with hot focal spots on its electrodes. Reignition sparks do not occur. The power output from electronic power supply unit 16 need only be designed for this reduced output of the lamp.

When normal lamp output is required once more, the conventional power supply unit 4 is again brought completely into operation. The lamp is brought up to its total output in three to five seconds.

Preferably, for longer interruptions in the normal output operation, a bottom standby mode can be brought into play. The lamp still receives an output of only a low percentage of the normal output, which, in the exemplary embodiment, is 1.5 percent of the normal output. In this operation mode, lamp 1 is operated to conserve energy. The current supplied from electronic power supply unit 16 is regulated so that the hot focal spots are maintained. With operation of lamp 1 in the bottom standby mode, both the assumed radiation output and also the energy-utilization are remarkably low. Lamp life is not shortened by this operation. In the bottom standby mode, lamp 1 is fed only from electronic power supply unit 16. By cutting-in conventional power supply unit 4, normal output can again be attained in the time required for connection of the lamp.

To assure ignition of the lamp in cold conditions and to facilitate ignition in warm conditions, electronic power supply unit 16 alone or together with conventional power supply unit 4 simply need be brought into operation. When lamp 1 burns steadily, electronic power supply unit 16 can again be disconnected.

While one embodiment has been chosen to illustrate the invention, it will be understood by those skilled in the art that various changes and modifications can be made therein without departing from the scope of the invention as defined in the appended claims.

What is claimed is:

1. A method of operating a high pressure gas discharge lamp in different operational modes, comprising the steps of:

selectively operating the lamp in a first operational mode powered at least predominantly with a low frequency energy supplied from a conventional power supply unit;

selectively operating the lamp in a second operational mode powered at least predominantly with a high frequency energy supplied from an electronic power supply unit connected to the lamp in parallel relative to the conventional power supply unit, electric output from the electronic power supply unit being regulated and maintained such that a second output level of the second operational mode is at a value less than about 25 percent of a first output level of the first operational mode, but adequate for steady lamp burning to save service life of the lamp;

powering the lamp simultaneously by the conventional power supply unit and the electronic power supply unit in the first operational mode; and switching the lamp to operating in the second operational mode by disconnecting the conventional power supply unit from the lamp while powering the lamp with the electronic power supply unit.

2. A method according to claim 1 wherein the value of the second output level is between about 10 percent and about 20 percent of first output level.

3. A method according to claim 1 wherein the value of the second output level is between about 10 percent and about 15 percent of the first output level.

4. A method according to claim 1 wherein the lamp is operated in a third operational mode at a third output level of a minimum value which is a a few percent of the first output level.

5. A method according to claim 4 wherein lamp current is regulated when the lamp is operated at the third output level.

6. A method according outstanding claim 5 wherein operation of the lamp at the third output level maintains hot spots on lamp electrodes of the lamp and avoids reignition sparks.

7. A method according to claim 4 wherein the lamp is brought from the second or third output level to the first output level in a short time period by cutting-in the low frequency energy from the conventional power supply unit.

8. A method according to claim 7 wherein the lamp is brought from the second output level to the first output level in less than about 10 seconds.

9. A method according to claim 7 wherein the lamp is brought from the second output level to the first output level in about 3 to 5 seconds.

10. A circuit arrangement for operating a gas discharge lamp in different operational modes, comprising:

a high pressure gas discharge lamp;

a conventional power supply unit, connected to said lamp through a separating impedance coil, for supplying electrical energy to said lamp at a first frequency, said conventional power supply unit being able to supply said lamp at least predominantly with energy;

an electronic power supply unit, connected to said lamp through a separating capacitor and in parallel relative to said conventional power supply unit, for supplying variable electrical energy to said lamp at a second frequency, said second frequency being higher than said first frequency, said electronic power supply unit being able to supply said lamp at least predominantly with energy;

means, coupled to said supply units, for operating both of said units simultaneously; and at least one filter on each output side of said power units and separating said power units from one another whereby, said lamp can be operated at different output levels in the different operational modes.

11. A circuit arrangement according to claim 10 wherein said separating impedance coil forms a part of a low-pass filter.

12. A circuit arrangement according to claim 10 wherein a resonance vibration circuit is connected between said electronic power supply and said separating capacitor.

13. A circuit arrangement according to claim 10 wherein said lamp is connected to both of said power supply units during operation.

14. A circuit arrangement according to claim 10 wherein changeover switch means switches operation of said lamp between powering said lamp by said conventional power supply unit and said electronic power supply unit, without lamp discharge being extinguished during the switching process.

15. A circuit arrangement according to claim 10 wherein said electronic power supply unit comprises control means for regulating at least one of a variable frequency, current or power supplied to said lamp.

16. A circuit arrangement according to claim 15 wherein said control means is connected to first and second transmitters to transmit actual values of current and output voltage supplied from said electronic power supply unit to said lamp.

17. A circuit arrangement according to claim 10 wherein said electronic power supply unit comprises at least one of a rectifier and a converter.

18. A circuit arrangement according to claim 17 wherein a transformer is connected in series to said one of said rectifier and said converter.

* * * * *